US009926703B1

(12) United States Patent
Muirhead et al.

(10) Patent No.: US 9,926,703 B1
(45) Date of Patent: Mar. 27, 2018

(54) PREFABRICATED MASONRY WALL PANELS

(71) Applicant: Constructive, L.L.C., Ferndale, MI (US)

(72) Inventors: Dave Muirhead, Milford, MI (US); Jim Gendron, Westland, MI (US)

(73) Assignee: CONSTRUCTIVE, LLC, Ferndale, MI (US)

( * ) Notice: Subject to any disclaimer, the term of this patent is extended or adjusted under 35 U.S.C. 154(b) by 0 days.

(21) Appl. No.: 15/188,747

(22) Filed: Jun. 21, 2016

Related U.S. Application Data

(63) Continuation-in-part of application No. 13/846,470, filed on Mar. 18, 2013, now abandoned, which is a (Continued)

(51) Int. Cl.
*E04C 2/52* (2006.01)
*E04B 2/00* (2006.01)

(Continued)

(52) U.S. Cl.
CPC ..... *E04C 2/526* (2013.01); *E04B 2/26* (2013.01); *E04C 1/00* (2013.01); *E04C 2/041* (2013.01); *E04C 2/06* (2013.01); *E04C 2/46* (2013.01)

(58) Field of Classification Search
CPC ... E04C 2/04; E04C 2/06; E04C 2/041; E04C 2/46; E04C 5/00; E04C 5/073; E04C 5/07;

(Continued)

(56) References Cited

U.S. PATENT DOCUMENTS 1,357,125 A 10/1920 Stanton
2,106,177 A * 1/1938 Hultquist ..... E04B 2/20 52/104

(Continued)

FOREIGN PATENT DOCUMENTS

DE 1484067 A1 12/1968
DE 9200057 U1 2/1992

(Continued)

OTHER PUBLICATIONS http://www.fortecstabilization.com/datasheets/FortecCarbonBars.pdf.*

(Continued)

*Primary Examiner* — Jessica Laux
(74) *Attorney, Agent, or Firm* — Young Basile Hanlon & MacFarlane, P.C.

(57) ABSTRACT

A hollow prefabricated masonry wall panel is made at a fabrication site and is configured for transportation to a build site. The hollow prefabricated wall panel has a base row and an upper row formed of hollow blocks. A slit is formed in the top of each of the two side walls of the hollow blocks of the base row and upper row, the slit having a width no larger than 20% a width of a side wall. Provisional reinforcement is provided within each slit with a bonding material, a size of the slit and the provisional reinforcement configured to provide tensile strength during transportation of the hollow prefabricated wall panel from the fabrication site to the build site. At least one mid-row is laid between the base row and upper row so the hollow cavities are aligned to preserve hollow wall cavities that can accept code required reinforcement once transported to the build site.

10 Claims, 8 Drawing Sheets

Related U.S. Application Data continuation-in-part of application No. 13/307,704, filed on Nov. 30, 2011, now abandoned, which is a continuation-in-part of application No. 13/274,502, filed on Oct. 17, 2011, now abandoned.

(60) Provisional application No. 61/439,863, filed on Feb. 5, 2011, provisional application No. 61/393,599, filed on Oct. 15, 2010.

(51) Int. Cl.

| | |
|---|---|
| ***E04C 1/00*** | (2006.01) |
| ***E04C 2/04*** | (2006.01) |
| ***E04C 2/06*** | (2006.01) |
| ***E04B 2/26*** | (2006.01) |

(58) Field of Classification Search

CPC ..... E04C 5/08; E04C 5/085; E04C 2002/001; E04C 2002/002; E04C 3/20; E04C 3/29; E04C 3/02; E04C 3/38; E04C 3/205; E04C 3/22; E04C 3/26; E04C 3/34; E04C 3/44; E04C 2003/023; E04C 2003/0404; E04C 2003/0413; E04C 2003/043; E04C 2003/0443; E04C 2003/0473; E04B 1/34336; E04B 1/34352; E04B 1/302; E04B 1/04; E04B 1/06; E04B 2/14; E04B 2/18; E04B 2/20; E04B 2/22; E04B 2/24; E04B 2/46; E04B 2/56; E04B 2/50; E04B 2/58; E04B 2/66; E04B 2/702; E04B 2/704; E04B 2002/0254

See application file for complete search history.

(56) References Cited

U.S. PATENT DOCUMENTS

| | | | | |
|---|---|---|---|---|
| 2,929,238 | A | 3/1960 | Kaye | |
| 2,994,162 | A | 8/1961 | Vimich | |
| 3,256,657 | A | 6/1966 | Phipps | |
| 3,314,208 | A | 4/1967 | Robertson et al. | |
| 3,529,390 | A * | 9/1970 | Stetter | E04B 2/18 52/285.1 |
| 3,936,987 | A | 2/1976 | Calvin | |
| 3,968,615 | A | 7/1976 | Ivany | |
| 4,034,529 | A | 7/1977 | Lampus | |
| 4,167,840 | A | 9/1979 | Ivany | |
| 4,302,414 | A | 11/1981 | Curnow et al. | |
| 4,319,440 | A | 3/1982 | Rassias et al. | |
| 4,769,961 | A | 9/1988 | Gillet | |
| 4,781,994 | A | 11/1988 | Enoki et al. | |
| 4,793,104 | A | 12/1988 | Hultberg et al. | |
| 4,819,395 | A | 4/1989 | Sugita et al. | |
| 4,902,537 | A | 2/1990 | Yamada et al. | |
| 4,910,076 | A | 3/1990 | Ando et al. | |
| 4,915,739 | A | 4/1990 | Sawanobori et al. | |
| 4,916,012 | A | 4/1990 | Sawanobori et al. | |
| 5,007,218 | A | 4/1991 | Bengtson et al. | |
| 5,099,628 | A | 3/1992 | Noland et al. | |
| 5,465,538 | A | 11/1995 | Powers, Jr. | |
| 5,623,797 | A | 4/1997 | Gravier et al. | |
| 5,686,181 | A | 11/1997 | Takano et al. | |
| 5,855,663 | A | 1/1999 | Takano et al. | |
| 6,065,265 | A | 5/2000 | Stenekes | |
| 6,088,987 | A * | 7/2000 | Simmons | E04B 2/14 405/285 |
| 6,098,357 | A | 8/2000 | Franklin et al. | |
| 6,189,282 | B1 | 2/2001 | VanderWerf | |
| 6,240,693 | B1 | 6/2001 | Komasara et al. | |
| 6,539,682 | B1 | 4/2003 | Ryder | |
| 6,557,830 | B2 | 5/2003 | Sutter | |
| 6,588,168 | B2 * | 7/2003 | Walters | E04B 2/14 52/604 |
| 6,735,913 | B2 | 5/2004 | Sanders et al. | |
| 6,758,020 | B2 | 7/2004 | Cerrato | |
| 6,851,239 | B1 | 2/2005 | Hohmann et al. | |
| 7,017,318 | B1 | 3/2006 | Hohmann et al. | |
| 7,285,167 | B2 | 10/2007 | Ogden | |
| 7,341,627 | B2 | 3/2008 | Ogden | |
| 7,454,870 | B2 | 11/2008 | Greenberg et al. | |
| 7,762,033 | B2 | 7/2010 | Scott et al. | |
| 7,971,407 | B2 * | 7/2011 | MacDonald | E04C 1/395 52/379 |
| 8,201,380 | B2 | 6/2012 | Hargest et al. | |
| 8,973,322 | B2 * | 3/2015 | Heron | E04C 5/08 52/223.7 |
| 2002/0148187 | A1 | 10/2002 | Walters | |
| 2003/0009970 | A1 | 1/2003 | MacDonald et al. | |
| 2003/0029114 | A1 | 2/2003 | MacDonald et al. | |
| 2004/0050006 | A1 | 3/2004 | Park et al. | |
| 2004/0159068 | A1 | 8/2004 | Prokofyev | |
| 2005/0108972 | A1 | 5/2005 | Banova | |
| 2006/0156673 | A1 | 7/2006 | Nakamura | |
| 2006/0201082 | A1 | 9/2006 | Hammer et al. | |
| 2007/0028541 | A1 | 2/2007 | Pasek | |
| 2008/0098934 | A1 | 5/2008 | Kwak et al. | |
| 2009/0188186 | A1 | 7/2009 | Ebanks | |
| 2010/0018150 | A1 | 1/2010 | Azar | |
| 2010/0043335 | A1 | 2/2010 | O'Connor | |
| 2010/0186335 | A1 | 7/2010 | Quinones | |
| 2011/0258957 | A1 | 10/2011 | Virnich | |
| 2012/0073230 | A1 * | 3/2012 | Klein | E04C 2/041 52/438 |
| 2015/0089825 | A1 | 4/2015 | Jones | |
| 2016/0194868 | A1 * | 7/2016 | DeBoer | E04B 2/32 52/604 |

FOREIGN PATENT DOCUMENTS

| | | | |
|---|---|---|---|
| DE | 10043609 | C1 | 10/2001 |
| DE | 102004063185 | A1 | 4/2006 |
| EP | 1650372 | A1 | 4/2006 |
| NL | 9101565 | A | 4/1993 |

OTHER PUBLICATIONS

Notification of Transmittal, International Search Report and Written Opinion of the International Searching Authority dated Jan. 20, 2012, from the corresponding International Application No. PCT/US2011/056523 filed Oct. 17, 2011.

* cited by examiner

PREFABRICATED MASONRY WALL PANELS

CROSS REFERENCE TO RELATED APPLICATIONS

This application is a continuation-in-part of U.S. patent application Ser. No. 13/846,470 filed on Mar. 18, 2013, which is a continuation-in-part of U.S. patent application Ser. No. 13/307,704 filed on Nov. 30, 2011, which is a continuation application of U.S. patent application Ser. No. 13/274,502 filed on Oct. 17, 2011, which claims priority to U.S. Provisional Patent Application Ser. No. 61/393,599 filed on Oct. 15, 2010 and U.S. Provisional Patent Application Ser. No. 61/439,863 filed on Feb. 5, 2011, all of which are incorporated herein in their entirety.

TECHNICAL FIELD

This disclosure provides a prefabricated masonry wall panel in lieu of a site-constructed wall. The disclosure relates in general to methods of making the prefabricated wall panel and in particular to wall panels configured with provisional reinforcement, allowing the prefabricated wall panels to be transported to a build location in a hollow form, without code-required reinforcing bars and grout.

BACKGROUND

Structures, including residential, commercial and industrial buildings, are made from masonry using individual masonry blocks laid and bound together by mortar. The common materials of masonry construction are clay brick masonry; stone, such as marble, granite, travertine, and limestone; and concrete block, including without limitation conventional concrete masonry units and autoclaved aerated concrete blocks. Masonry is generally a highly durable form of construction. However, the materials used, the quality of the mortar and workmanship, and the pattern in which the blocks are assembled can significantly affect the durability of the overall masonry construction.

Concrete masonry is a commonly used building material composed of individual blocks whose basic composition is concrete. The blocks can be hollow or solid. Concrete is strong in compression and weak in tension. For concrete that is cast at the building site, adding embedded reinforcement during pouring can provide tensile capacity. Reinforcement is not used in individual concrete masonry blocks, but masonry blocks constructed of hollow units require code-required vertical reinforcement at the build site to comply with building codes, and therefore receive the reinforcement at the build site as pluralities of blocks are mortared into units.

Masonry grout is similar to concrete and is poured into the hollow concrete masonry units at the build site to hold the code-required vertical reinforcement, both vertically and in horizontal channels of bond beam block. Concrete, concrete masonry blocks, mortar, and masonry grout all contain Portland cement. Care needs to be taken to properly cure the grout and achieve the required strength. However, proper curing can be a challenge as typical build sites are outdoor areas subjected to environmental conditions that are different depending on the location and time of year.

Currently, individual masonry blocks are transported to the build site where they are laid and mortared into courses or rows, with code-required vertical reinforcement installed as and after the courses are laid. To build a structure over about five feet in height, scaffolding is usually necessary to support the masons while they work. Weather can affect the progress of the masonry when laid on site as well.

SUMMARY

Disclosed herein are embodiments of prefabricated compound masonry assemblies in lieu of build site-constructed elements, and methods of producing the same. One embodiment of a prefabricated compound masonry unit is a wall panel. A hollow prefabricated masonry wall panel is made at a fabrication site and is configured for transportation to a build site. The hollow prefabricated wall panel has a base row and an upper row formed of hollow blocks. A slit is formed in the top of each of the two side walls of the hollow blocks of the base row and upper row, the slit having a width no larger than 20% a width of a side wall. Provisional reinforcement is provided within each slit with a bonding material, a size of the slit and the provisional reinforcement configured to provide tensile strength during transportation of the hollow prefabricated wall panel from the fabrication site to the build site. At least one mid-row is laid between the base row and upper row so the hollow cavities are aligned to preserve hollow wall cavities that can accept code required vertical reinforcement once transported to the build site.

Another embodiment of a hollow prefabricated masonry wall panel made at a fabrication site and configured for transportation to a build site comprises a base row and an upper row each formed from hollow blocks. Each hollow block has a hollow cavity open to a top and a bottom of the hollow block, two end walls and two side walls defining the hollow cavity. The hollow blocks are laid end wall to end wall with adjacent end walls adhered with mortar such that the hollow cavity within each hollow block remains open to the top and the bottom of the hollow block. Each of the base row and the upper row have a first side wall with a first top surface and a second side wall with a second top surface formed from the two side walls of the mortared hollow blocks. A first slit is formed in the first top surface and along a length of the first side wall of each of the base row and the upper row, each first slit having a width no larger 20% of a width of the first top surface. A second slit is formed in the second top surface and along the length of the second side wall of each of the base row and the upper row, each second slit having a width no larger than 20% a width of the second top surface. Provisional reinforcement is fully embedded within each first slit and each second slit with bonding material different from the mortar, a size of each first slit and second slit and the respective provisional reinforcement configured to provide tensile strength during transportation of the hollow prefabricated masonry wall panel from the fabrication site to the build site. At least one mid-row is formed between the base row and the upper row and mortared to the first top surface and the second top surface of the base row, the at least one mid-row formed of additional hollow blocks laid end wall to end wall with adjacent end walls adhered with mortar such that the hollow cavity within each hollow block is vertical, open to the top and the bottom of the hollow block. The hollow cavity of each hollow block of the base row, the upper row and the at least one mid-row is aligned to preserve continuous hollow wall cavities that can accept code required reinforcement at the build site. The hollow prefabricated masonry wall panel is transported with no grout and no code-required vertical reinforcement.

Methods of making the prefabricated masonry wall panel for transportation from a fabrication site to a build site are also disclosed. One method comprises forming a base row from a plurality of hollow blocks, each hollow block having a hollow cavity open to a top and a bottom of the hollow block, two end walls and two side walls defining the hollow cavity, wherein the hollow blocks are laid end wall to end wall with adjacent end walls adhered with mortar to form the base row such that the hollow cavity within each hollow block is vertical, open to a top and a bottom of the hollow block. A slit is formed in a top surface of and along a length of each of the two side walls of the hollow blocks of the base row, each slit having a width no larger than one-quarter inch. Provisional reinforcement is embedded within each slit with a bonding material different from the mortar. At least one mid-row is formed on the base row, the at least one mid-row formed of additional hollow blocks, each additional hollow block having a hollow cavity open to a top and a bottom of the hollow block, two end walls and two side walls defining the hollow cavity, wherein the hollow blocks are laid end wall to end wall with adjacent end walls adhered with mortar such that the hollow cavity within each hollow block is vertical, open to a top and a bottom of the hollow block, the hollow cavity of each hollow block of the base row and the at least one mid-row aligned to preserve hollow wall cavities. An upper row is formed on top of the at least one mid-row from further additional hollow blocks, each hollow block having a hollow cavity open to a top and a bottom of the hollow block, two end walls and two side walls defining the hollow cavity, wherein the hollow blocks are laid end wall to end wall with adjacent end walls adhered with mortar to form the base row such that the hollow cavity within each hollow block is vertical, open to a top and a bottom of the hollow block. The hollow cavity of each hollow block of the base row, the upper row and the at least one mid-row are aligned to preserve the hollow wall cavities to accept code-required vertical reinforcement at a permanent location, wherein the prefabricated masonry wall panel is transportable with the hollow wall cavities hollow. A slit is formed in a top surface and along a length of each of the two side walls of the hollow blocks of the upper row, each slit having a width no larger than one-quarter inch, and additional provisional reinforcement is embedded within each slit with additional bonding material different from the mortar, a size of the slit and the provisional reinforcement in both of the base row and the upper row configured to provide tensile strength during transportation of the prefabricated wall panel from a fabrication site to the build site.

A method of moving the hollow prefabricated masonry wall panel from the fabrication site to the build site includes inserting vertical post-tensioning rods at intervals along a length of the hollow prefabricated masonry wall panel into the hollow wall cavities, at least some of the post-tensioning rods having rings at a top end for connecting to a lifting beam, loading the hollow prefabricated masonry wall panel onto a truck using the lifting beam and a crane and transporting the prefabricated masonry wall panel from the fabrication location to the permanent build site with no grout in the vertical hollow wall cavities. Once at the build site, the post-tensioning rods are removed and the hollow prefabricated masonry wall panel is incorporated into a wall structure by adding code-required vertical reinforcement and grout into the hollow wall cavities.

BRIEF DESCRIPTION OF THE DRAWINGS

The description herein makes reference to the accompanying drawings wherein like reference numerals refer to like parts throughout the several views.

DETAILED DESCRIPTION

Figure 1:
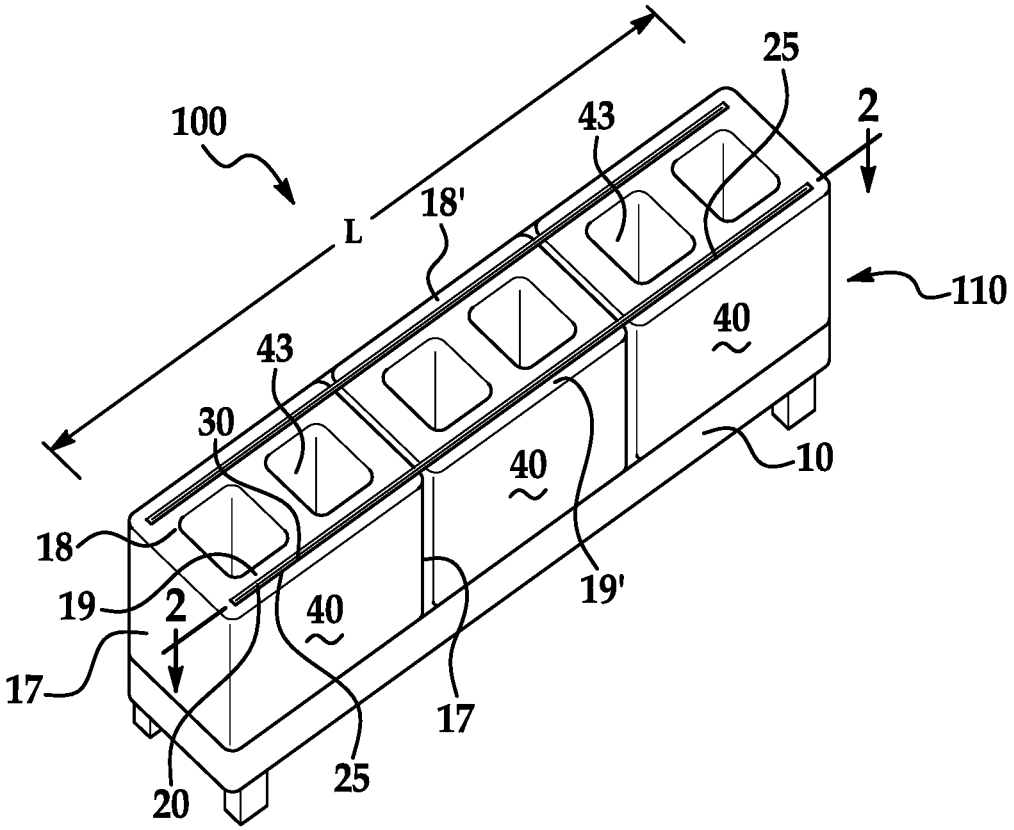
FIG. 1 is a perspective view of a base row of a prefabricated masonry wall panel disclosed herein.
Figure 2:
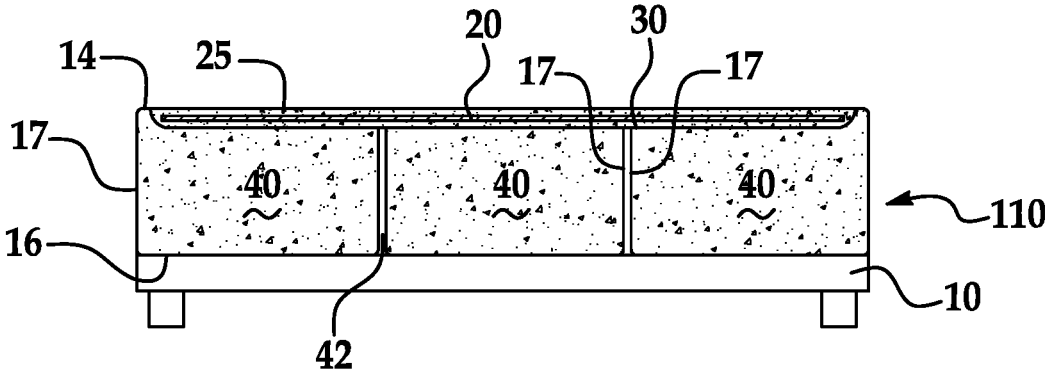
FIG. 2 is a cross sectional view of FIG. 1 along line 2-2.

Prefabricated compound masonry assemblies as disclosed herein include individual concrete masonry blocks combined into wall panels, lintels and other compound masonry assemblies at a fabrication site and reinforced at specific locations within the assembly with provisional reinforcement, used specifically to provide structural support so that the prefabricated assemblies can be transported to the build site without loss of mortar or cracks in mortar joints. The provisional reinforcement for transportation provides tensile strength to the wall panels, lintel and other assemblies so that they can be lifted, transported, handled and installed at the build site. Once the prefabricated compound masonry assembly is erected at the build site, code-required vertical reinforcement, such as rebar, is inserted into the hollow cavities of the assembly and grouted in place.

Code-required vertical reinforcement is not used until the prefabricated compound masonry assembly is erected in its permanent position within a larger structure. Code-required vertical reinforcement is installed at the build site to accommodate the loadings or forces imposed on the structural elements once the overall structure is completed. The building code requires that the reinforcement be steel bars with ASTM designation A615, A706, A767, A775 or A996, and any horizontal reinforcement be steel wire meeting ASTM designation A951. The steel material has a yield strength $f_{fu}$ of between 56,000 psi and 70,000 psi. The steel bar reinforcement is installed at the build site and placed vertically in the open cells or cavities of the masonry units and horizontally in the hollow, recessed horizontal cavity of a U-shaped block, and then grouted. The steel wire reinforcement is installed at the fabrication site and placed horizontally in the bed joints between the rows of blocks and mortared. The mortar and grout are cement-based materials meeting ASTM designation C270 and C476, respectively. Once mortared or grouted in place, the code-required vertical reinforcement is considered permanent reinforcement for the structure. Code-required vertical reinforcement can be described as permanent, installed at build site, steel reinforcing bars, grouted steel reinforcement, or grouted vertical bars. Code-required horizontal reinforcement can be described as permanent, and is of two kinds: steel reinforcing bars, grouted in place only at the build site; and steel wire reinforcement, mortared in place between masonry courses at the fabrication site.

As used herein, "provisional reinforcement" is distinctly different from code-required or permanent reinforcement and is installed at the fabrication site with bonding material for the sole purpose of facilitating lifting, handling and transporting prefabricated compound masonry assemblies from the fabrication site to the build site. Provisional reinforcement must have high strength to provide the tensile strength to the prefabricated compound masonry assemblies to safely support the loads imposed by lifting, handling and transporting the prefabricated compound masonry assemblies, and yet be small enough to fit within narrow slits formed in each side wall of the hollow blocks. Steel reinforcement, whether bar or wire, cannot meet both of these requirements. An example of a provisional reinforcement, without limiting other materials, is fiber reinforced polymer (FRP) in sheet (plate) or woven (⅛-inch diameter tows) configuration. This provisional reinforcement has properties such as $f_{fu}$=700,000 psi tensile (yield) strength; $\epsilon_{fu}$=0.019 rupture strain; $\epsilon_f$=0.016 design strain (85% of rupture); $E_f$=36,000,000 psi elastic modulus. One example of provisional reinforcement that meets these requirements is Fortec Grid™ fiber reinforced polymer. The narrow FRP (⅛ inch) has the ability to be placed in single or multiple layers in the slits in the walls of the hollow blocks and elsewhere. Provisional reinforcement can be described as temporary, installed at the fabrication site, reinforcement for transportation, or FRP or other material. Steel materials such as rebar cannot be used due to steel's lower tensile strength. A piece of steel that could provide the requisite tensile strength would need to be one inch in diameter, or two steel bars of ½-inch diameter each. Slits large enough to accommodate such reinforcement would ruin the integrity of the blocks.

FRP is not permitted by the building code for permanent reinforcement yet is approximately 10 times stronger than steel reinforcement. One ⅛-inch diameter FRP tow has the approximate strength of one ½-inch diameter steel reinforcement bar. FRP provides a unique means for serving as provisional reinforcement; steel bars would be far too large to provide the tensile strength required to lift and transport the hollow prefabricated masonry assemblies and would add significant weight to the assemblies for lifting and transporting.

Once bonded into place, provisional reinforcement is considered temporary reinforcement to facilitate lifting, handling and transporting prefabricated compound masonry assemblies from the fabrication site to the build site. Following placement of the code-required or permanent reinforcement at the build site, the provisional reinforcement can have no further utility in the assembly and in the overall structure.

"Bonding material," used to adhere the provisional reinforcement to the masonry assemblies, is distinctly different from masonry mortar or grout. The bonding material can be epoxy resin, epoxy gel, epoxy grout or other equivalents; it is not cement-based like mortar or grout. The bonding material is selected for compatibility with the provisional reinforcement. It cannot be used to bond masonry units together. Bonding material allows the small width of the tows (⅛-inch) to be installed in a slit only 3⁄16 inch wide; mortar could not do this. A narrow slit is necessary to limit the area of contact between the mortar used between adjacent blocks and the bonding material, minimizing any debonding that might occur between bonding material and mortar caused by applying the mortar over hardened bonding material. A narrow slit for thin provisional reinforcement has the added benefit of minimizing the amount of bonding material needed, reducing cost.

The prefabricated masonry wall panels are transported to the build site hollow and without code-required vertical reinforcement. Herein, "hollow" means that vertical openings in the prefabricated masonry wall panel are not transported with grout or code-required vertical reinforcement, leaving the vertical openings available for the code-required vertical reinforcement to be installed at the build site. At the build site, or permanent site, the prefabricated wall panels are incorporated into a building structure and have code-required vertical reinforcement, such as rebar, grouted therein. The provisional reinforcement used for transportation is not intended to, and cannot by code, replace the code-required vertical reinforcement, such as rebar, that is necessary to install at the build site to meet code requirements.

As used herein "fabrication site" refers to a site that is typically enclosed and that is a location different from the build site. The fabrication site can be any distance from the build site. The prefabricated compound masonry assemblies are built at the fabrication site and transported from there to the build site. The fabrication site is a controlled factory setting using the fabrication methods disclosed herein to produce prefabricated compound masonry assemblies that can be easily and safely transported and easily integrated into permanent building applications. This procedure uses craftsmen trained in the discipline of masonry and schooled in the new methods disclosed herein of incorporating provisional reinforcement for strategic advantages of strength during transportation and handling. Process monitoring of the build would produce design compliance, assuring the ability of the units to meet strict code conformance at the build site when permanent code-required vertical reinforcement is installed with product quality regardless of the weather, site limitations and the natural environment.

As used herein "build site" is the site on which a structure is being built and to which the prefabricated compound masonry assemblies are transported for incorporating into the larger structure. The grouting of code-required vertical reinforcement, such as rebar, as required by building code, is done only at the build site.

The prefabricated compound masonry assemblies have many advantages over using individual blocks assembled at the build site or concrete poured at the build site. Prefabricated compound masonry assemblies will increase the speed of putting up the building at the build site. The prefabricated compound masonry assemblies are adaptable for add-ons for last minute owner requirements. The prefabricated compound masonry assemblies are built using the existing contingent of building trades. Use of the prefabricated compound masonry assemblies can eliminate work stoppage due to weather conditions and lessen site damage of the individual blocks and other components. The use of the prefabricated compound masonry assemblies can provide "ease of building" on tight or busy sites and also provide safer construction solutions.

The prefabricated compound masonry assemblies are manufactured in a weather-protected, controlled-temperature environment of between 60° F. and 85° F., so cold-weather protection, hot weather protection, and wind protection for masonry are not required. Cement-based materials require a moist, controlled environment to gain strength and harden fully. The mortar cement paste hardens over time, initially setting and becoming rigid and gaining in strength in the days and weeks following.

These advantages are provided as examples and are not meant to be limiting. Those skilled in the art will recognize these advantages and more associated with the prefabricated compound masonry assemblies and their use.

The prefabricated compound masonry assemblies can be made to any overall shape and size desired or required by those skilled in the art so long as the assemblies include the requisite provisional reinforcement in the requisite sized slit to allow transportation. Examples of applications for which the use of the prefabricated compound masonry units is contemplated include but are not limited to the following: columns, walls, corners, floors, roofs, headers for doors and windows, lintels, beams, posts, ledges, wall sections, wall sections with returns, gable ends, arches, and piers.

The prefabricated compound masonry assemblies can be built on a build base 10 as seen in FIG. 1. The build base 10 is shown near but slightly raised off the ground; however, the build base 10 can be raised to any level for the comfort of the builder. However, the build base 10 does not need to be raised off the ground. The build base 10 is leveled so that the resulting prefabricated masonry wall panel 100 built on the base 10 is level. The building materials can be laid directly on the build base 10 or a base cover can be used to cover the build base 10 to prevent build-up of building materials such as epoxy and mortar on the build base 10.

One embodiment of a prefabricated compound masonry assembly is a prefabricated masonry wall panel 100 made at a fabrication site and configured for transportation to a build site as illustrated in FIGS. 1-5. The prefabricated masonry wall panel 100 comprises a base row 110 and an upper row 120, each formed of hollow blocks 40 laid end wall 17 to end wall 17 with adjacent end walls 17 adhered with mortar 42. As used herein, "mortar" refers to the typical material used by builders at a build location to adhere individual blocks together. Non-limiting examples of the mortar include mortar for unit masonry complying with ASTM C270, and ready-mixed mortar complying with ASTM C 1142. As used herein, "row" refers to two or more individual blocks combined to create a course of blocks adhered end to end. A block can be clay brick masonry; stone, such as marble, granite, travertine, and limestone; or concrete block, including without limitation, conventional concrete masonry units such as hollow stretcher blocks shown in the figures, or autoclaved aerated concrete block. Typical blocks used for wall panels are Concrete Masonry Units, ASTM C 90, except with a minimum average net area compressive strength of 3,600 psi, unless a lower strength will provide the specified masonry strength $f'_m$. Nominal unit sizes of 8-inch, 10-inch and 12-inch lengths with a center web on 12-inch units are typical. The minimum face shell, or side wall, thickness for units to receive provisional reinforcement for transportation is as follows:

8-inch and 10-inch lintels: 1¼ inches.

8-inch and 10-inch stretchers: 1¼ inches 12-inch lintels: 1¼ inches for face shells and center web.

12-inch stretchers: 1¼ inches for face shell.

Each hollow block 40 has a hollow cavity 43 open to a top 14 and a bottom 16 of the hollow block 40, with two end walls 17 and two side walls 18, 19 defining the hollow cavity 43. The blocks 40 in FIGS. 1-5 are stretcher blocks, with two hollow cavities per block. This is an illustration and is not meant to be limiting. The hollow blocks 40 are laid such that the hollow cavity 43 within each hollow block 40 is vertical, open to the top 14 and the bottom 16 of the hollow block 40. Each of the base row 110 and upper row 120 have a first side wall 18' with a first top surface and a second side wall 19' with a second top surface formed from the side walls 18, 19 and the top 14 of the hollow blocks 40.

Figure 5:
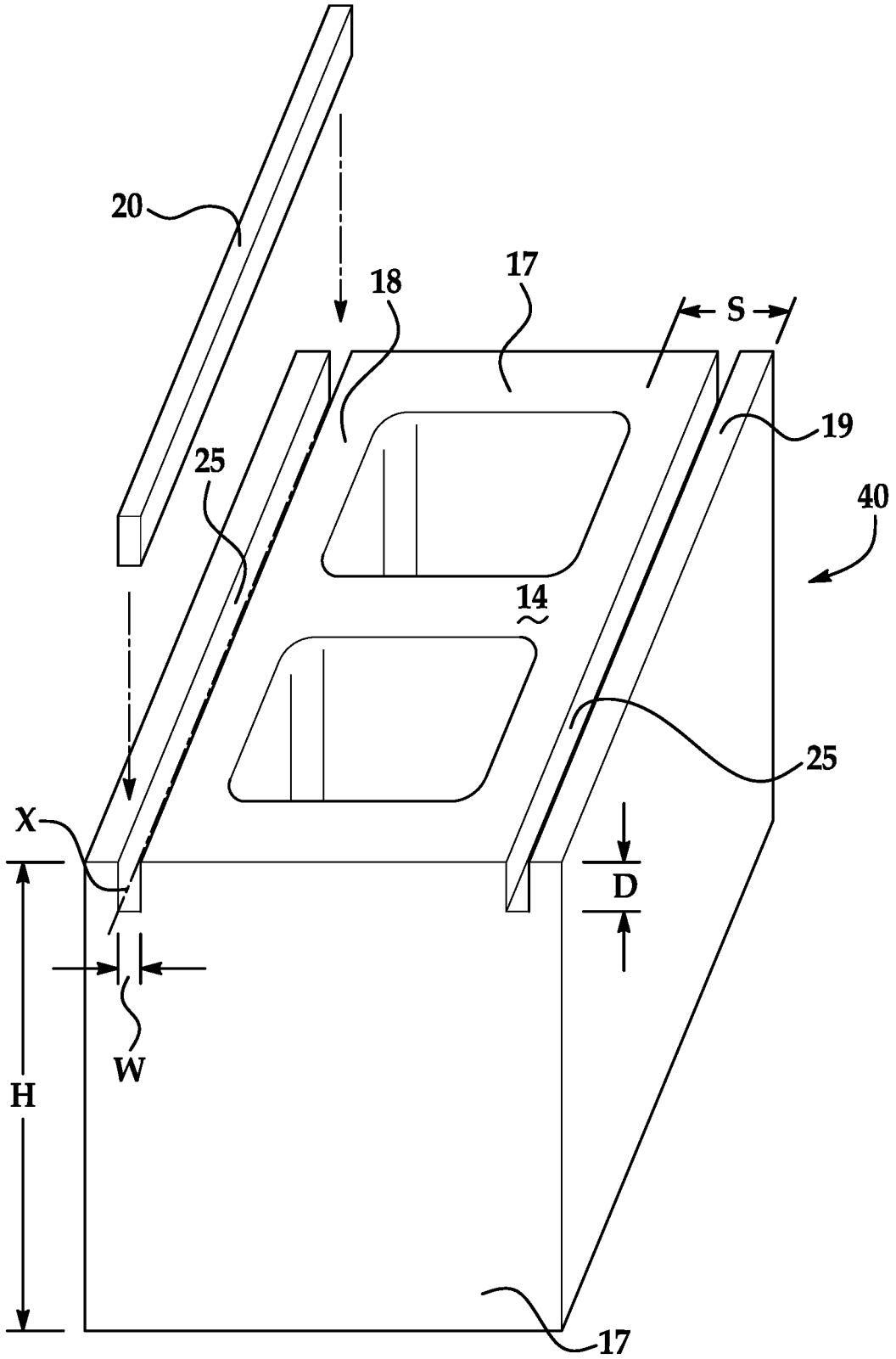
FIG. 5 is an enlarged perspective view of a base row or upper row to show the slit as disclosed herein.

In each of the base row 110 and upper row 120, a slit 25 is formed in the top 14 surface of each of the two side walls 18, 19 of the hollow blocks. In other words, a slit 25 is formed in the first top surface of the first side wall 18' and another slit 25 is formed in the second top surface of the second side wall 19' of each of the base row 110 and the upper row 120. Each slit 25 is specifically sized to receive provisional reinforcement 20 to provide the necessary tensile strength required to transport the hollow prefabricated wall panel 100. Each slit 25 can be saw cut or molded into individual blocks 40 prior to forming the row, or each slit 25 can be saw cut after the row is formed. The size of the slit 25 should be just large enough to embed the provisional reinforcement 20 in the slit 25 with bonding material 30. That is, in some embodiments, the provisional reinforcement 20 is selected so as to minimize the corresponding width of slit 25 in order to maximize the remaining surface area of top 14 surface to enhance mortar bonding. As illustrated in FIG. 5, in some embodiments, each slit 25 is formed having a depth D greater than its width W. Each slit 25 has a width W no larger than ¼" wide when used in conventionally sized blocks. For a conventional concrete masonry stretcher block having a height H of 7⅝" and a side wall width S of 1¼", the depth D of the slit 25 can be ½" while the width W of the slit 25 can be ¼". In some embodiments where the size of the hollow blocks vary from conventional blocks, the provisional reinforcement 20 can be selected and the corresponding width of the slit 25 chosen such that the width of the slit 25 is no more than about 20% of the width of top 14 surface of the side walls 18, 19 of the hollow blocks. A non-limiting example of the dimensions of the slit 25 is ½" deep by 3/16" wide. Each slit 25 can extend the entire length of the respective row or can stop before longitudinal ends of each row. The slit 25 is cut across the mortared joints so that the slit 25 is continuous along the respective row. The slit 25 can be made directly along the center axis X of each side wall 18, 19.

Provisional reinforcement 20 is provided within each slit 25 with a bonding material 30 different from the mortar 42, as mortar does not meet the requirements necessary to provide the requisite tensile strength, as discussed above. As a non-limiting example, the slit 25 is filled with bonding material 30 to ¾ full. The provisional reinforcement 20 is pushed into the slit 25 until it is fully embedded in the slit 25 and completely covered with the bonding material 30. Any excess bonding material 30 on the top 14 of the block 40 is removed. Excess bonding material 30 that is not removed could interfere with the adhesion of a row of block mortared on top of the base row 110.

The provisional reinforcement 20 can come in different forms. For example, the provisional reinforcement 20 can come in plate form. The plate is a somewhat stiff yet still flexible sheet, i.e., it will spring back after it is flexed. The plate is cut into strips for use as the provisional reinforcement. As another example, the provisional reinforcement can come in the form of tows. The tows may come laced together (by Kevlar or nylon) into arrays, so that the array is one tow wide and more than one tow deep. The tows themselves are flexible and are approximately ⅛ inch in diameter. The arrays of tows can come coiled in rolls. Provisional reinforcement 20 has limited stretch, thereby providing the tensile reinforcement required when the prefabricated compound masonry assembly 100 is lifted, transported, etc. The amount and configuration of the provisional reinforcement will change depending on one or more of the dimensions, weight, lifting configuration and application of the resulting prefabricated compound masonry assembly 100. However, most hollow prefabricated masonry wall panels require at a minimum provisional reinforcement 20 that is ⅛ inch wide and ¼ inch high. The remaining area of the slit 25 is filled with bonding material 30. The provisional reinforcement 20 can also be mesh or shaped FRP. The shapes can include, as non-limiting examples, tows, rods, biscuits and other joinery known to those skilled in the art. The tows, rods or biscuits can be placed along joints of adjacent blocks 40 in the slits 25 if provided, in existing openings in the individual units or in apertures cut into the individual units specifically to receive the shaped FRP. The type and shape of FRP used can depend on the type of hollow block used.

An example of provisional reinforcement 20 meets the following minimum properties when sized to fit into the slit 25 so that lifting and transporting the hollow prefabricated wall panel is possible: $f_{fu}$=700,000 psi tensile strength; $\epsilon_{fu}$=0.019 rupture strain; $\epsilon_f$=0.016 design strain (85% of rupture); $E_f$=36,000,000 psi elastic modulus. These parameters provide the flexural strength and the strength to resist shear while reinforcing the hollow wall panel during lifting and transportation. One example of provisional reinforcement 20 that meets these requirements is fiber reinforced polymer by Fortec Grid™. This provisional reinforcement 20 has nearly ten times the tensile strength of code-required steel reinforcement bars. Equivalent materials that meet these requirements when sized to fit into the dimensions of the slit 25 are acceptable. The provisional reinforcement 20 can have a tensile strength $f_{fu}$ of at least 500,000 psi. The provisional reinforcement 20 can extend along substantially an entire length L of the base row 110 and upper row 120. Both the slits 25 and the provisional reinforcement 20 can end just short of each end of the rows or can extend the entire length L of the rows 110, 120.

Figure 3:
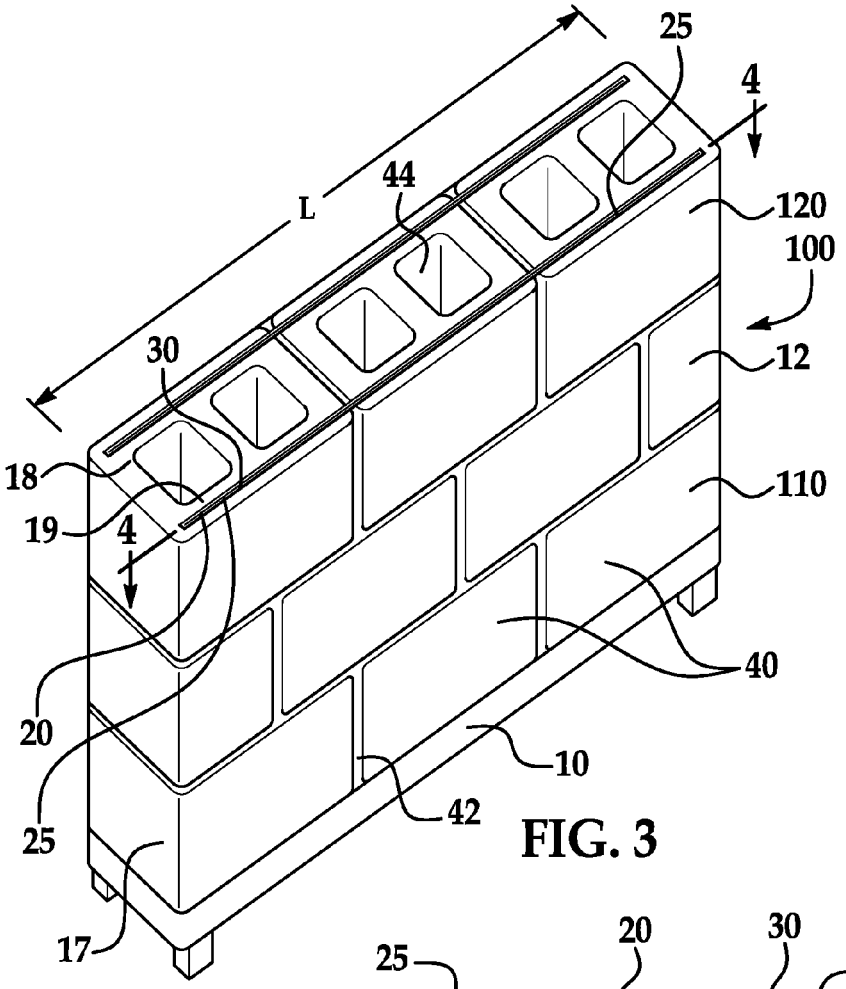
FIG. 3 is a perspective view of an embodiment of a prefabricated masonry wall panel.
Figure 4:
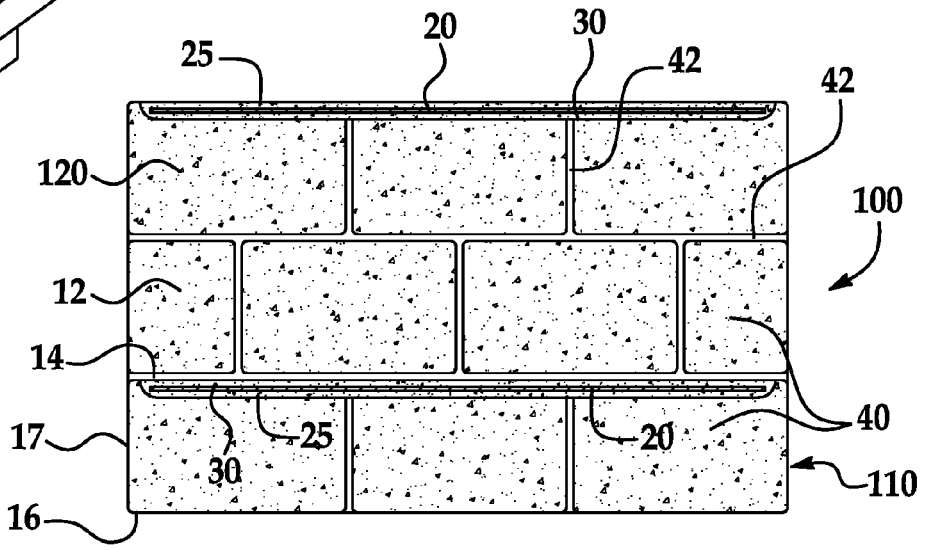
FIG. 4 is a cross sectional view of FIG. 3 along line 4-4.

To complete the hollow prefabricated masonry wall panel 100, at least one mid-row 12 is laid between the base row 110 and the upper row 120. FIGS. 3 and 4 illustrate one mid-row 12 in the prefabricated masonry wall panel 100 as a non-limiting example. The number of mid-rows 12 is determined by the required size of prefabricated wall panel for each build project. Each mid-row 12 is formed of additional hollow blocks 40, each additional hollow block 40 having the hollow cavity 43 open to the top 14 and the bottom 16 of the hollow block 40. The hollow blocks 40 are laid end wall 17 to end wall 17 with adjacent end walls 17 adhered with mortar 42 such that the hollow cavity 43 within each hollow block 40 is vertical. The hollow cavity 43 of each hollow block 40 of the base row 110, the upper row 120 and each mid-row 12 are aligned to preserve continuous hollow wall cavities 44 that can accept the code-required vertical reinforcement at the build site. The prefabricated masonry wall panel 100 is transportable with the hollow wall cavities 44 having no grout and no code-required vertical reinforcement.

Figure 6A:
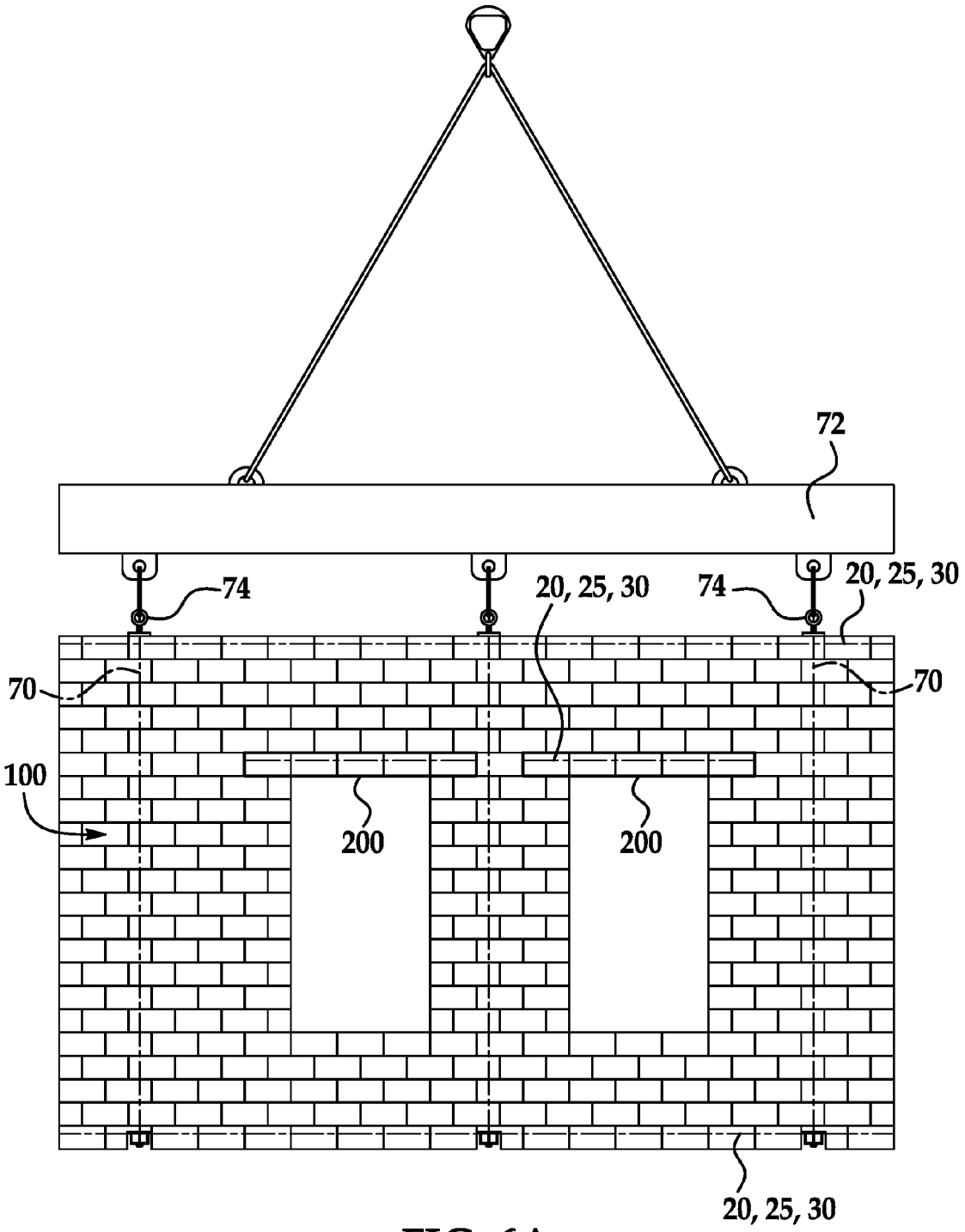
FIG. 6A is a schematic view of a prefabricated masonry wall panel being hoisted with a lifting beam.
Figure 6B:
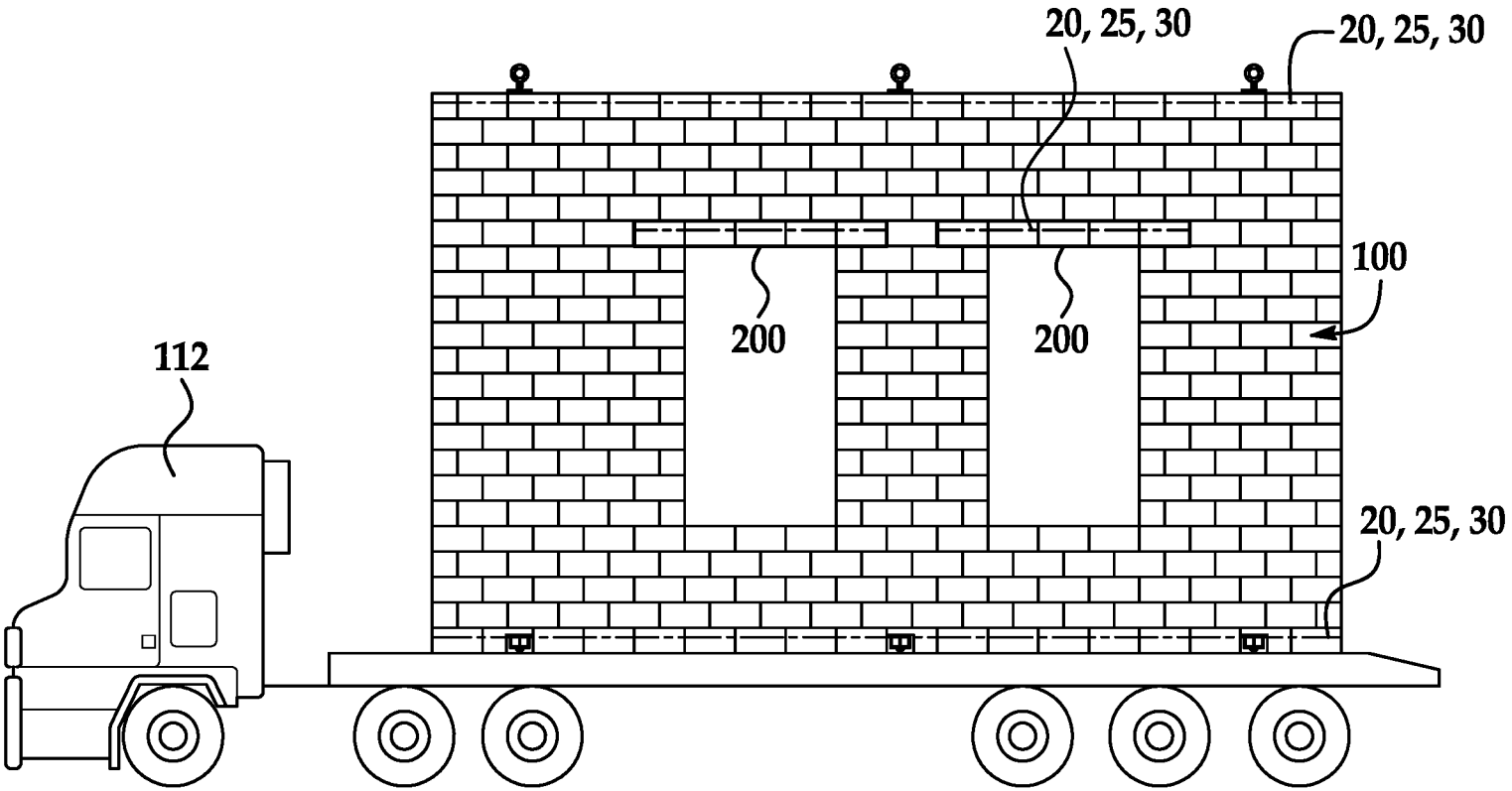
FIG. 6B is a side view of a prefabricated masonry wall panel loaded on a means of transportation to transport the prefabricated masonry wall panel from a fabrication site to a build site.

The prefabricated masonry wall panel 100 can be made with the base row 110 and the upper row 120 having a first length, and some or all of the mid-rows 12 formed intermittent along the first length to form a window, door or other opening in the prefabricated masonry wall panel 100, illustrated in FIGS. 6A and 6B.

Depending on the type and size of the prefabricated masonry wall panel 100 required, the rows 12, 110, 120 may be made of any number of hollow blocks 40. When the base row 110 is complete with the provisional reinforcement 20 retained within the slits 25 with the bonding material 30, and cured if required, a mid-row 12 is laid with mortar on top of the base row 110. One or more additional mid-rows 12 of blocks 40 can be laid and mortared as required to achieve the final dimensions of the prefabricated wall panel 100. When the number of layers is complete, the top layer is formed into the upper row 120, with additional provisional reinforcement 20 incorporated into the slits 25 of the upper row 120 as described. The prefabricated masonry wall panel 100 is limited by the maximum masonry strain not to exceed 0.0025 in./in. and the allowable strain and stress requirements of the provisional reinforcement. Minimum panel strength prior to tensioning, moving and handling is $f_m$, =2,700 psi.

The base row 110 can be formed of blocks 40 with the slits 25 cut into the base row 110, or the slits 25 can be cut into each block 40 and the blocks 40 formed into the base row 110. The provisional reinforcement 20 is embedded in the respective slits 25 with bonding material 30, and any excess bonding material 30 is removed from the surface of the base row 110. The at least one mid-row 12 is formed on top of the base row 110. The upper row 120 can be formed of blocks 40 with the slits 25 cut into the upper row 120 after the upper row is mortared to the top of the at least one mid-row 12, or the slits 25 can be cut into each block 40 and the blocks 40 formed into the upper row 120 on top of the at least one mid-row 12.

The prefabricated masonry wall panels 100 made at the fabrication site can now be transported to the build site. Being able to transport the prefabricated masonry wall panels 100 in a hollow state, with no grout or code-required vertical reinforcement, provides flexibility to construction workers, enabling them to incorporate any number of rows. Transporting the prefabricated wall panels 100 as hollow is unique and significantly reduces the weight of the panel, allowing for lower cost and easier handling.

FIG. 6A illustrates one method for the lifting of a prefabricated masonry wall panel 100. The hollow prefabricated wall panel 100 illustrated in FIGS. 6A and 6B shows in broken line the location of the slits 25, provisional reinforcement 20 and bonding material 30. Because the prefabricated wall panel 100 shown in FIGS. 6A and 6B also has window openings, two prefabricated lintels 200, described below, are also illustrated.

To lift the hollow prefabricated wall panel 100 onto the truck 112 shown in FIG. 6B, a lifting beam 72 is connected to vertical post-tensioning bars 70 that have been fitted with rings 74 and inserted at intervals into the continuous hollow wall cavities 44 of the prefabricated wall panel 100. The post-tensioning bars 70 are removable and reuseable, and must be removed at the build site prior to the introduction of code-required vertical reinforcement. A crane is used to lift the prefabricated masonry wall panel 100 to and from the truck 112 or other means of transportation. Shoring or bracing (not shown) can be provided to the prefabricated masonry wall panel 100 after it is on the truck 112 for further protection and stabilization during travel. Other means of lifting and moving the units can be used and can be dependent on the size and weight of the unit to be transported, including the use of slings or stiffbacks.

Once at the build site, the hollow prefabricated masonry wall panel 100 is lifted from the truck 112 and placed at the build site. Once the hollow prefabricated masonry wall panel 100 is set in place in the larger structure, the post-tensioning bars 70 are removed. The continuous hollow vertical wall cavities can then receive the code-required vertical reinforcement and grout.

Another example of a prefabricated compound masonry assembly is a prefabricated lintel. Lintels, for example, are typically a single row made up of a plurality of blocks to form a horizontal support across the top of a door or window opening. A prefabricated lintel would typically be transported as a single row. However, the methods herein also include adding one or more rows at the fabrication site depending on the type of unit being made.

FIGS. 7-12 and 14 illustrate different prefabricated lintel designs. The prefabricated lintels incorporate the slits 25, provisional reinforcement 20 and bonding material 30 as described with regard to the prefabricated wall panels 100, so like reference numbers will be used.

Figure 7:
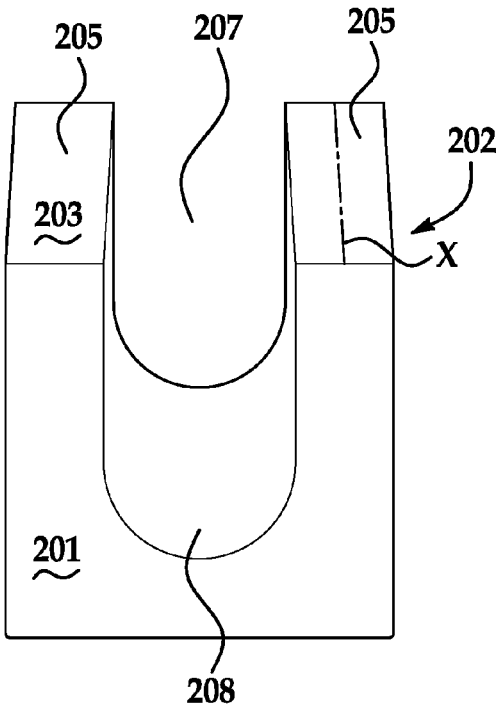
FIG. 7 is a perspective view of a U-shaped block.

A prefabricated masonry lintel 200 has a base row 150 formed from a plurality of U-shaped blocks 202, such as U-shaped solid bond beam blocks as shown in FIG. 7. Each U-shaped block 202 has a recess 207 formed from the U-shape of the block 202 between side walls 205 of the block 202. The recess 207 has a continuous solid U-shaped surface 208 extending between opposing ends 201 of the block 202 with no open cavities extending through the continuous U-shaped surface 208 of the recess 207. The continuous U-shaped surface 208 of the recess 207 has a low point Y below a midpoint X of a height H of the side wall of the U-shaped block 202, illustrated in FIG. 10.

The plurality of U-shaped blocks 202 of the base row 150 are laid end 201 to end 201 with adjacent ends 201 adhered with mortar 42. The mortar is the same as that used in the prefabricated masonry wall panels 100, so the reference number is the same. The resulting base row 150 has a continuous hollow horizontal cavity 209 that runs the length L of the base row 150.

Figure 8:
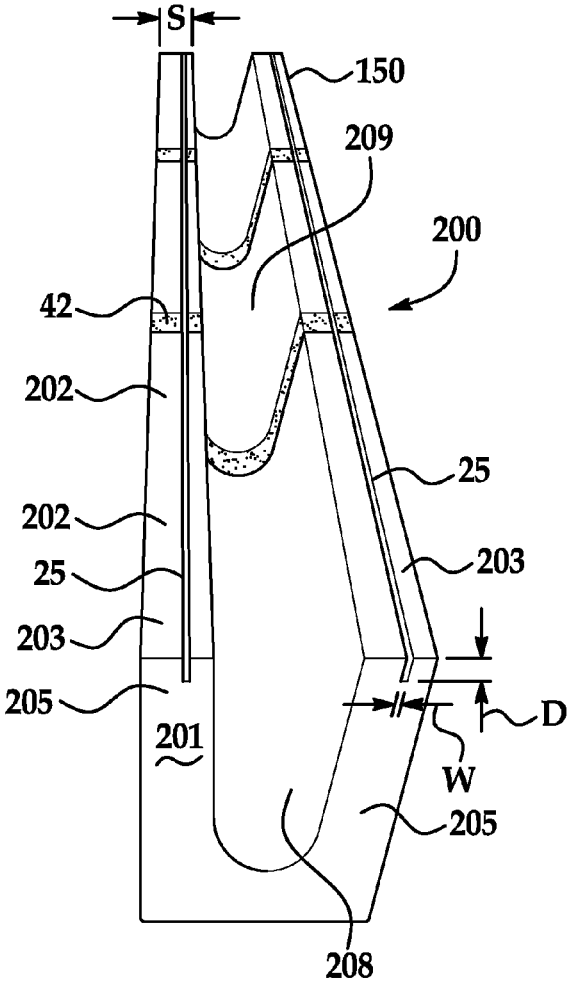
FIG. 8 is a perspective view of a prefabricated lintel showing the slits.

In each side wall 205 of the base row 150, a slit 25 is formed in a top surface 203 of each of the two side walls 205. The slit 25 is specifically sized to receive provisional reinforcement 20 for transportation. Each slit 25 can be saw cut or molded into individual blocks 202 prior to forming the base row 150, or each slit 25 can be saw cut after the base row 150 is formed. The size of the slit 25 is important. The slit 25 is specifically sized to receive provisional reinforcement 20 to provide the necessary tensile strength required to transport the hollow prefabricated masonry lintel 200. The size of the slit 25 should be just large enough to embed the provisional reinforcement 20 in the slit 25 with bonding material 30. That is, in some embodiments, the provisional reinforcement 20 is selected so as to minimize the corresponding width of slit 25 in order to maximize the remaining surface area of top 14 surface to enhance mortar bonding. As illustrated in FIG. 8, in some embodiments, each slit 25 is formed having a depth D greater than its width W. Each slit 25 has a width W no larger than ¼" wide when used in conventionally sized blocks. For a conventional concrete masonry stretcher block having a height H of 7⅝" and a side wall width S of 1¼", the depth D of the slit 25 can be ½" while the width W of the slit 25 can be ¼". In some embodiments where the size of the hollow blocks vary from conventional blocks, the provisional reinforcement 20 can be selected and the corresponding width of the slit 25 chosen such that the width of the slit 25 is no more than about 20% of the width of top 14 surface of the side walls 18, 19 of the hollow blocks. A non-limiting example of the dimensions of the slit 25 is ½" deep by 3/16" wide. Each slit 25 can extend the entire length of the respective row or can stop before longitudinal ends of each row. The slit 25 is cut across the mortared joints so that the slit 25 is continuous along the respective row. The slit 25 can be made directly along the center axis X of each side wall 18, 19.

Provisional reinforcement 20 is provided within each slit 25 with a bonding material 30 different from the mortar 42, as mortar does not meet the requirements necessary to provide the requisite tensile strength, as discussed above. As a non-limiting example, the slit 25 is filled with bonding material 30 to ¾ full. The provisional reinforcement 20 is pushed into the slit 25 until it is fully embedded in the slit 25 and completely covered with the bonding material 30. Any excess bonding material 30 on the top 203 of the block 202 is removed. Excess bonding material 30 that is not removed could interfere with the adhesion of a row of block mortared on top of the base row 150.

Figure 9:
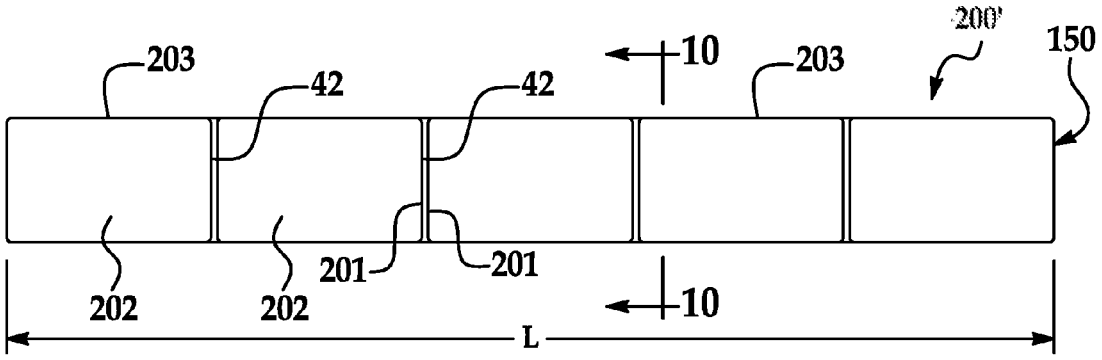
FIG. 9 is a side view of another embodiment of a prefabricated lintel as disclosed herein.
Figure 10:
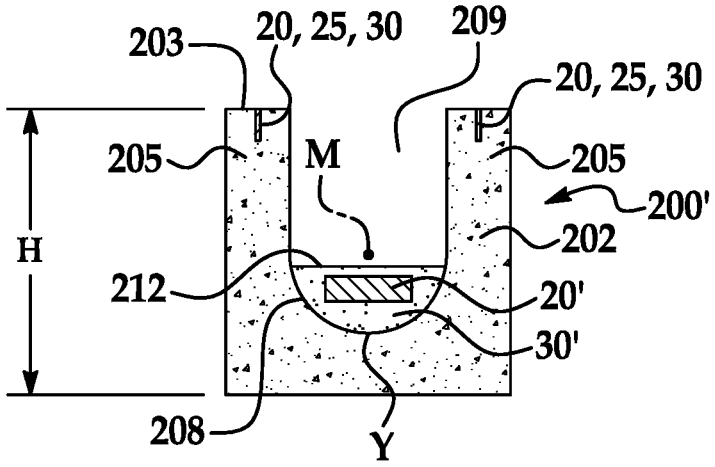
FIG. 10 is a cross sectional view of FIG. 9 along line 10-10.
Figure 11:
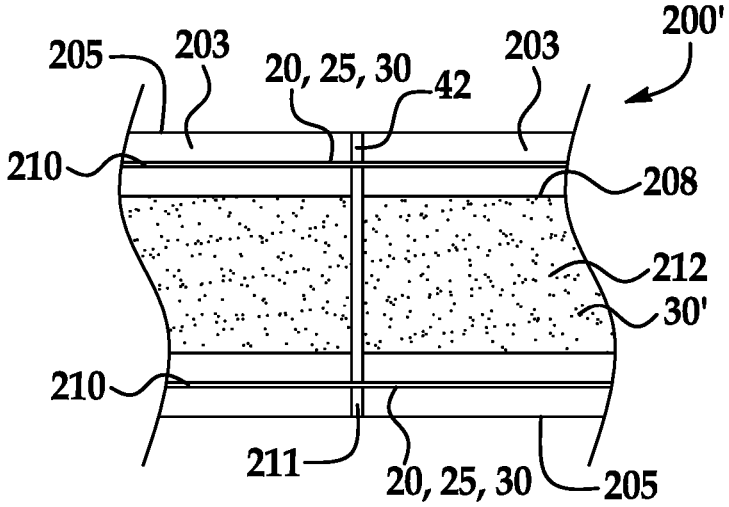
FIG. 11 is a plan view of FIG. 9.

FIG. 9 is a side view of the base row 150 of another embodiment of the prefabricated masonry lintel 200'. FIG. 10 is a cross-sectional view of FIG. 9 along line 10-10 and FIG. 11 is a plan view of a portion of FIG. 10. As shown in FIG. 10, in addition to the slits 25 formed in the top surface 203 of the side walls 205 of the U-shaped block 202, additional provisional reinforcement 20' is laid along the continuous U-shaped surface 208 of the continuous hollow horizontal cavity 209 and held in place with additional bonding material 30'. An upper surface 212 of the additional reinforcement 20' and bonding material 30' is at a height below the midpoint X of the height H of the side wall 205 so that the provisional reinforcement 20 is positioned to resist the tensile forces at the bottom of the base row 150 during transportation. The hollow space above the upper surface 212 provides sufficient hollow space at the build site to receive the code-required reinforcement in the continuous hollow horizontal cavity 209 at the build site. The upper surface 212 of the bonding material 30' is intentionally roughened so that, when it hardens, it will bond with the grout that is placed in the hollow horizontal cavity 209 at the build site when the code-required reinforcement is installed.

The provisional reinforcement 20' can run the length of the hollow horizontal cavity 209. It is also contemplated that the provisional reinforcement 20' only be placed in or on the continuous U-shaped surface 208 across mortared joints of adjacent U-shaped blocks 202.

Figure 12:
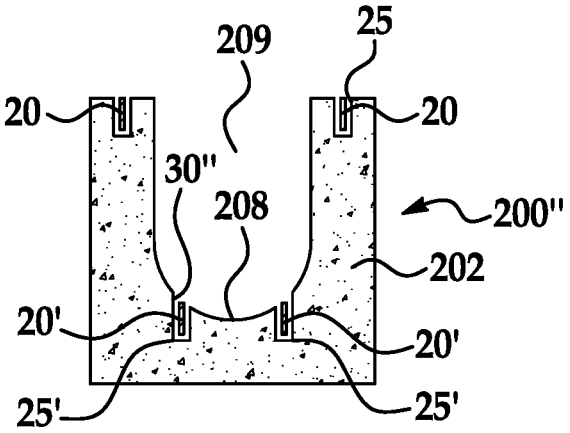
FIG. 12 a cross-sectional view of another embodiment of a prefabricated lintel as disclosed herein.

FIG. 12 is another embodiment of the prefabricated masonry lintel 200 of FIG. 8. In FIG. 12, additional slits 25' are formed along the length L of the base row 150 in a bottom of the continuous U-shaped surface 208 of the hollow horizontal cavity 209. The slits 25 are saw cut or molded as the other slits are. Additional reinforcement 20' is embedded in each additional slit 25' and held in place with additional bonding material 30'. The hollow horizontal cavity 209 is preserved to accept the code-required reinforcement at the build site. The prefabricated masonry lintel 200 is transportable with the continuous hollow horizontal cavity 209 having no grout and no code-required reinforcement.

Figure 13:
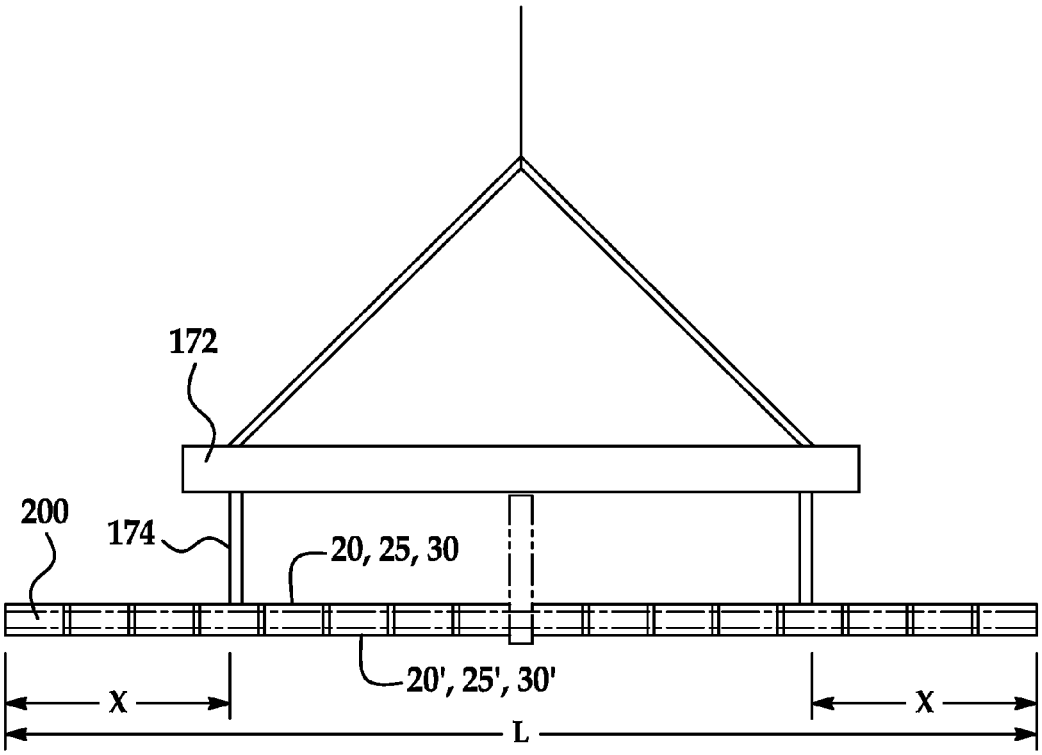
FIG. 13 is a schematic view of a prefabricated masonry lintel being hoisted with a lifting beam.

FIG. 13 illustrates one method for lifting of prefabricated masonry lintels disclosed herein. A broken line is used on the hollow prefabricated masonry lintel 200 to represent locations of slits 25, 25', provisional reinforcement 20, 20', and bonding material 30, 30'. To lift the prefabricated masonry lintel 200 onto a truck, for example, a lifting beam 172 is connected to choker slings 174 that are wrapped around the hollow prefabricated masonry lintel 200. Two or more choker slings 174 can be used depending on the length L of the prefabricated masonry lintel 200. A crane is used to lift the prefabricated masonry lintel 200 to and from the truck or other means of transportation.

To install the prefabricated masonry lintels described herein, after transporting the prefabricated masonry lintel 200 from the fabrication site to the build site with the hollow horizontal cavity 209 having no grout, the prefabricated masonry lintel 200 is placed over an opening in a wall structure and incorporated into the wall structure by adding code-required reinforcement and grout into the hollow horizontal cavity 209 of the prefabricated masonry lintel 200.

Figure 14:
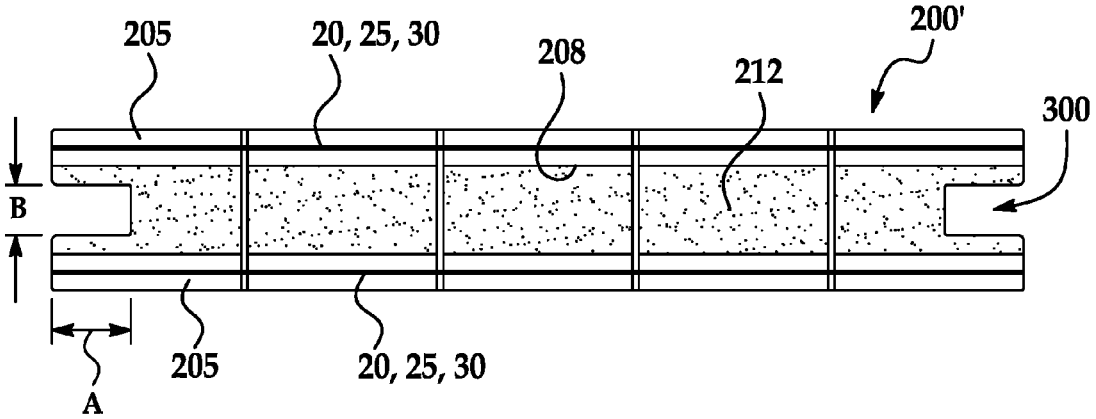
FIG. 14 is a plan view of a prefabricated lintel incorporating cut-outs.

FIG. 14 is a plan view of the prefabricated masonry lintels 200' disclosed herein having cut-outs 300 on either end 302, 304 of the lintel 200'. The cut-outs 300 can be used with any of the prefabricated masonry lintels 200, 200', 200" disclosed herein. The cut-out 300 is saw cut out of the bottom of the continuous U-shaped surface 208, leaving the side walls 205 intact to the end 302, 304 of the lintel 200'. The dimensions of the cut-outs 300 can vary. As non-limiting examples, the cut-out 300 can be 12" in length A and 5" in width B or 6" in length A and 5" in width B. The cut-out 300 can be the same size at each end or can be a different size at each end. The prefabricated masonry lintel may only have a cut-out 300 at one end.

The cut-outs 300 provide the following advantages. When a prefabricated lintel as disclosed herein is built at the fabrication site and transported to the build site, the prefabricated lintel is incorporated into the overall structure by setting the prefabricated lintel onto two ends of masonry columns that have had code-required vertical steel reinforcement placed into the outer edges of the masonry columns. When the prefabricated lintel is set on those columns, the code-required vertical reinforcement would be located where the bottom of the prefabricated lintel would otherwise be. By adding the cut-outs 300 to the prefabricated lintel at the fabrication site, the code-required vertical reinforcement can pass up through the cut-out 300 in the prefabricated lintel when the prefabricated lintel is placed. The cavities into which the code-required vertical reinforcement is placed get filled with grout when the code-required horizontal reinforcement is added to the prefabricated lintel at the build site. The column's code-required vertical reinforcement and the lintel's code-required horizontal reinforcement will cross one another in the end of the lintel, which of course is incorporated in the column.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as are permitted under the law.

What is claimed is:

1. A hollow prefabricated masonry wall panel made at a fabrication site and configured for transportation to a build site, the hollow prefabricated masonry wall panel comprising:

a base row and an upper row each formed from:

hollow blocks, each hollow block having a hollow cavity open to a top and a bottom of the hollow block, two end walls and two side walls defining the hollow cavity, wherein the hollow blocks are laid end wall to end wall with adjacent end walls adhered with mortar such that the hollow cavity within each hollow block remains open to the top and the bottom of the hollow block, wherein each of the base row and the upper row have a first side wall with a first top surface formed thereon and a second side wall with a second top surface formed thereon;

a first slit formed in the first top surface continuously along at least a majority of a length of the first side wall of each of the base row and the upper row, each first slit having a width no wider than 20% of a width of the first top surface; a second slit formed in the second top surface continuously along at least a majority of a length of the second side wall of each of the base row and the upper row, each second slit having a width no wider than 20% of a width of the second top surface; and provisional reinforcement fully embedded within each first slit and each second slit with bonding material different from the mortar, such that the provisional reinforcement is flush with or below the first top surface and the second top surface, a size of each first slit and second slit and the respective provisional reinforcement configured to provide tensile strength during transportation of the hollow prefabricated masonry wall panel from the fabrication site to the build site;

at least one mid-row between the base row and the upper row and mortared to the first top surface and the second top surface of the base row, the at least one mid-row formed of additional hollow blocks laid end wall to end wall with adjacent end walls adhered with mortar such that the hollow cavity within each hollow block is vertical, open to the top and the bottom of the hollow block, the hollow cavity of each hollow block of the base row, the upper row and the at least one mid-row aligned to preserve continuous hollow wall cavities that can accept reinforcement at the build site, wherein the hollow prefabricated masonry wall panel is configured to be transported with no grout and no vertical reinforcement.

2. The hollow prefabricated masonry wall panel of claim 1, wherein the provisional reinforcement is fiber reinforced polymer.

3. The hollow prefabricated masonry wall panel of claim 2, wherein the fiber reinforced polymer has the following properties: $f_{fu}$=700,000 psi tensile strength; $\epsilon_{fu}$=0.019 rupture strain; $\epsilon_f$=0.016 design strain (85% of rupture); $E_f$=36,000,000 psi elastic modulus.

4. The hollow prefabricated masonry wall panel of claim 1, wherein the provisional reinforcement has a tensile strength of greater than 500,000 psi.

5. The hollow prefabricated masonry wall panel of claim 1, wherein each first slit and each second slit has a depth that is greater than the width.

6. The hollow prefabricated masonry wall panel of claim 5, wherein the depth of each first slit and each second slit is no greater than one-half inch.

7. The hollow prefabricated masonry wall panel of claim 1, wherein each first side wall and each second side wall have a width of at least 1¼ inches and each first slit and each second slit has the width of 3/16 inch.

8. The hollow prefabricated masonry wall panel of claim 1, wherein each first slit and each second slit is no larger than ¼ inch regardless of the width of each first top surface and each second top surface.

9. The hollow prefabricated masonry wall panel of claim 1, wherein the bonding material for the provisional reinforcement is an epoxy resin.

10. A method of installing the hollow prefabricated masonry wall panel of claim 1 comprising: transporting the hollow prefabricated masonry wall panel from the fabrication site to the build site with the hollow wall cavities containing no grout or vertical reinforcement; and positioning the hollow prefabricated masonry wall panel at the build site and adding vertical reinforcement and grout into the hollow wall cavities.

* * * * *